United States Patent [19]

Kelly

[11] Patent Number: 4,736,562

[45] Date of Patent: Apr. 12, 1988

[54] BATTEN SPOKE ARRANGEMENT FOR RUBBER ROOFING INSTALLATION

[76] Inventor: Thomas L. Kelly, 31 Sands St., Waterbury, Conn. 06010

[21] Appl. No.: 898,263

[22] Filed: Aug. 20, 1986

Related U.S. Application Data

[63] Continuation-in-part of Ser. No. 632,026, Jul. 18, 1984, abandoned.

[51] Int. Cl.[4] ..... E04B 5/00

[52] U.S. Cl. ..... 52/173 R; 52/199; 52/303; 52/410; 52/467; 52/748

[58] Field of Search ..... 52/24, 25, 26, 82, 94, 52/95, 96, 198, 199, 506–512, 515, 408–410, 462, 463, 466, 469, 716, 543, 544, 173 R, 303, 748

[56] References Cited

U.S. PATENT DOCUMENTS

| | | | |
|---|---|---|---|
| 3,133,377 | 5/1964 | Jackson | 52/24 |
| 4,074,492 | 2/1978 | Simpson et al. | 52/544 X |
| 4,382,353 | 5/1983 | Kelly | 52/506 |
| 4,437,283 | 3/1984 | Benoit | 52/410 |
| 4,445,306 | 5/1984 | Schauffele | 52/410 |
| 4,538,388 | 9/1985 | Friesen | 52/303 X |

FOREIGN PATENT DOCUMENTS

| | | | |
|---|---|---|---|
| 2300798 | 7/1974 | Fed. Rep. of Germany | 52/410 |

OTHER PUBLICATIONS

"Architectural Record", Aug. 1984, p. 38, Carlisle Syntec System, product advertisement.

*Primary Examiner*—Alfred C. Perham
*Assistant Examiner*—Richard E. Chilcot, Jr.
*Attorney, Agent, or Firm*—Hayes & Reinsmith

[57] ABSTRACT

A roofing installation having a plurality of substrates including a deck; a flexible membrane in overlying relation to the substrates and forming an upper roof surface, and a plurality of battens for securing the membrane to the underlying substrates, the battens being arranged in a radial pattern directed radially outward from a central region of the roofing installation, the radial pattern allowing for communication between regions of the flexible membrane partitioned by adjacent batten placements and roof edges, thereby providing for controlled ballooning and for dispersion of wind uplift forces throughout the roofing installation. Also, a roofing installation having a plurality of substrates including a deck; a flexible membrane in overlying relation to the substrates and forming and upper roof surface, the flexible membrane comprising at least one continuous manufactured sheet having manufactured seams perpendicular to the length of the sheet and at least a portion of the roof edge; and a plurality of battens for securing the membrane to the underlying substrates, the battens being arranged perpendicular to said portion of the roof edge and extending along at least certain of the manufactured seams, the battens permitting communication between regions partitioned by adjacent batten placements and the portion of the roof edge thereby providing for controlled ballooning and for dispersion of wind uplift forces in the roofing installation. Also, a method of installing a roof over a roof substrate by applying a flexible membrane over the roof substrate; placing a plurality of battens over the roof substrate in the desired pattern; securing the placed battens to the roof substrate; and securing the placed battens to the flexible membrane.

25 Claims, 8 Drawing Sheets

BATTEN SPOKE ARRANGEMENT FOR RUBBER ROOFING INSTALLATION

This application is a continuation-in-part of U.S. patent application Ser. No. 632,026, filed July 18, 1984, now abandoned.

BACKGROUND OF THE INVENTION

The present invention relates to roofing systems utilizing flexible roofing sheets.

The most generally known and used methods of applying flexible roofing sheets to supporting structures involves positioning the sheets against the supported structure and then securing the sheets by driving a headed fastener such as a screw through the sheet into the supporting structure or running a series of battens overlying the membrane in parallel to the edge of the roof and then driving a headed fastener such as a nail through the batten and sheet and into the supporting structure. There are many problems associated with these methods, some involving maintaining an effective weather seal around the nail, some relating to the relatively slow process of positioning and driving nails through the sheet or batten into the support structure, and others having to do with the effective dispersion of wind uplift forces under which certain high wind conditions may subject opposed inside and outside surfaces of a given roof to pressure differentials wherein wind forces create vacuum zones on the outside roof membrane. Under such high wind conditions, relatively positive high pressure may occur under the roof membrane by air infiltration into gaps under the membrane, when compared to the existing atmospheric pressure exerted on the exterior of a roof membrane. Such positive pressure has been known to blow the roof membrane from its support structure. In connection with this latter point, it has been determined that the conventional method of applying a series of battens in parallel to the edge of a roof essentially seals off interior areas of a roofing installation. Such interior areas are subject to wind uplift conditions which create pressure differentials to cause tearing of the membrane around the batten or the batten itself being blown off the roof. These results cause unnecessary waste and undesirable replacement costs.

It is therefore an object of the present invention to provide a means and method for controlling ballooning in a roofing system.

It is another object of the present invention to provide a means and method for equalizing air pressure in a roofing system.

It is a further object of the present invention to provide an improved method for installing a roofing system.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

SUMMARY OF THE INVENTION

In one aspect, the present invention comprises a roofing installation having a plurality of substrates including a deck, a flexible membrane in overlying relation to the substrates and forming an upper roof surface, and a plurality of battens for securing the membrane to the underlying substrates, the battens being arranged in a radial pattern directed radially outward from a central region of the roofing installation, the radial pattern allowing for communication between regions of the flexible membrane partitioned by adjacent batten placements and roof edges, thereby providing for controlled ballooning and for dispersion of wind uplift forces throughout the roofing installation.

In another aspect, the present invention comprises a method of installing a roof over a roof substrate by applying a flexible membrane over the roof substrate; placing a plurality of battens over the roof substrate in a radial pattern directed outwardly from a central region of the roof substrate; securing the placed battens to the roof substrate; and securing the placed battens to the flexible membrane, thereby permitting communication between regions of the flexible membrane partitioned by the placed and secured battens and the roof edge, and providing for controlled ballooning and for dispersion of wind uplift forces in the roof.

In a further aspect, the present invention comprises a roofing installation having a plurality of substrates including a deck; a flexible membrane in overlying relation to the substrates and forming an upper roof surface, the flexible membrane comprising at least one continuous manufactured sheet having manufactured seams perpendicular to the length of the sheet and to at least a portion of the roof edge; and a plurality of battens for securing the membrane to the underlying substrates, the battens being arranged perpendicular to the portion of the roof edge and extending along at least certain of the manufactured seams, the battens permitting communication between regions partitioned by adjacent batten placements and the portion of the roof edge, thereby providing for controlled ballooning and for dispersion of wind uplift forces in the roofing installation.

In yet another aspect, the present invention comprises a method of installing a roof over a roof substrate by providing a flexible membrane comprising at least one continuous manufactured sheet having spaced manufactured seams penpendicular to the length of the sheet; applying the flexible membrane over the roof substrate such that the manufactured seams are perpendicular to at least a portion of the roof edge; placing a plurality of battens over the roof substrate perpendicular to a portion of the roof edge and spaced apart a distance equal to an integer multiple of the spacing of the flexible membrane manufactured seams; aligning the flexible membrane manufactured seams and the battens in lapping relationship; securing the placed battens to the roof substrate; and securing the placed battens to the flexible membrane, thereby permitting communication between regions of the flexible membrane partioned by the placed and secured battens and the portion of the roof edge, and providing for controlled ballooning and for dispersion of wind uplift forces in the roof.

DETAILED DESCRIPTION OF THE INVENTION

This invention concerns an improved means and method of allowing wind dispersion throughout a flexible roofing installation and which is particularly useful in combination with one way valves which equalize relatively positive and negative air pressures which occur between the underside of the flexible membrane and the top of the roofing installation. A plurality of the valves are placed within the roofing installation to further facilitate the dispersion of wind uplift stresses. The one way roof pressure equalizing valves are disclosed in U.S. Pat. No. 4,557,081 to Thomas L. Kelly of Waterbury, Conn., the same inventor of the present invention.

The battens employed in the present invention can also be combined with a layer of adhesive compositions, such as butyl gum, or other pressure sensitive adhesives bonded to one side of the batten. The adhesive composition in turn is coated with a protective material which is easily peeled off to expose the adhesive allowing for precise placement of the batten on roofing surface. Rubber or plastic compositions may also be bonded to one side of the batten and heat welded or solvent welded to allow firm placement on the roofing structure. Installation is simple, rapid and efficient; the adhesive bearing batten is merely placed in a desired position on the flexible roof membrane and the fastening elements can be driven into holding engagement with the supporting structure. Such construction further minimizes undesired batten movement during the fastening procedure due to the adhesive contact between the batten and flexible membrane.

To provide significantly improved and controlled ballooning of flexible roofing membranes and accommodation of wind uplift stresses to prevent roofing membranes from ripping or tearing about their fasteners or battens under wind uplift conditions, the preferred embodiment of this invention comprises a series of radially extending battens directed outwardly from a central region of a roofing installation towards the edges of a roof for dispersion of wind uplift forces below the flexible roof membrane throughout the roofing installation. The described arrangement of battens has been found to preclude any area of the roof installation being sealed off and thereby prevent undesired air entrapment while providing improved dispersion of wind uplift forces throughout the roof installation below the sheet membrane.

This invention also may utilize ready-to-install battens which include a layer of adhesive prebonded to one side of each batten to facilitate its placement and installation of the battens in roof installation.

Also disclosed herein is an improved roofing installation which combines the radial batten arrangement and one way valves to facilitate the dispersion of wind uplife forces below the flexible membrane throughout the roofing installation which is a more effective and reliable protective construction than other conventional installations of its type.

Figure 1:
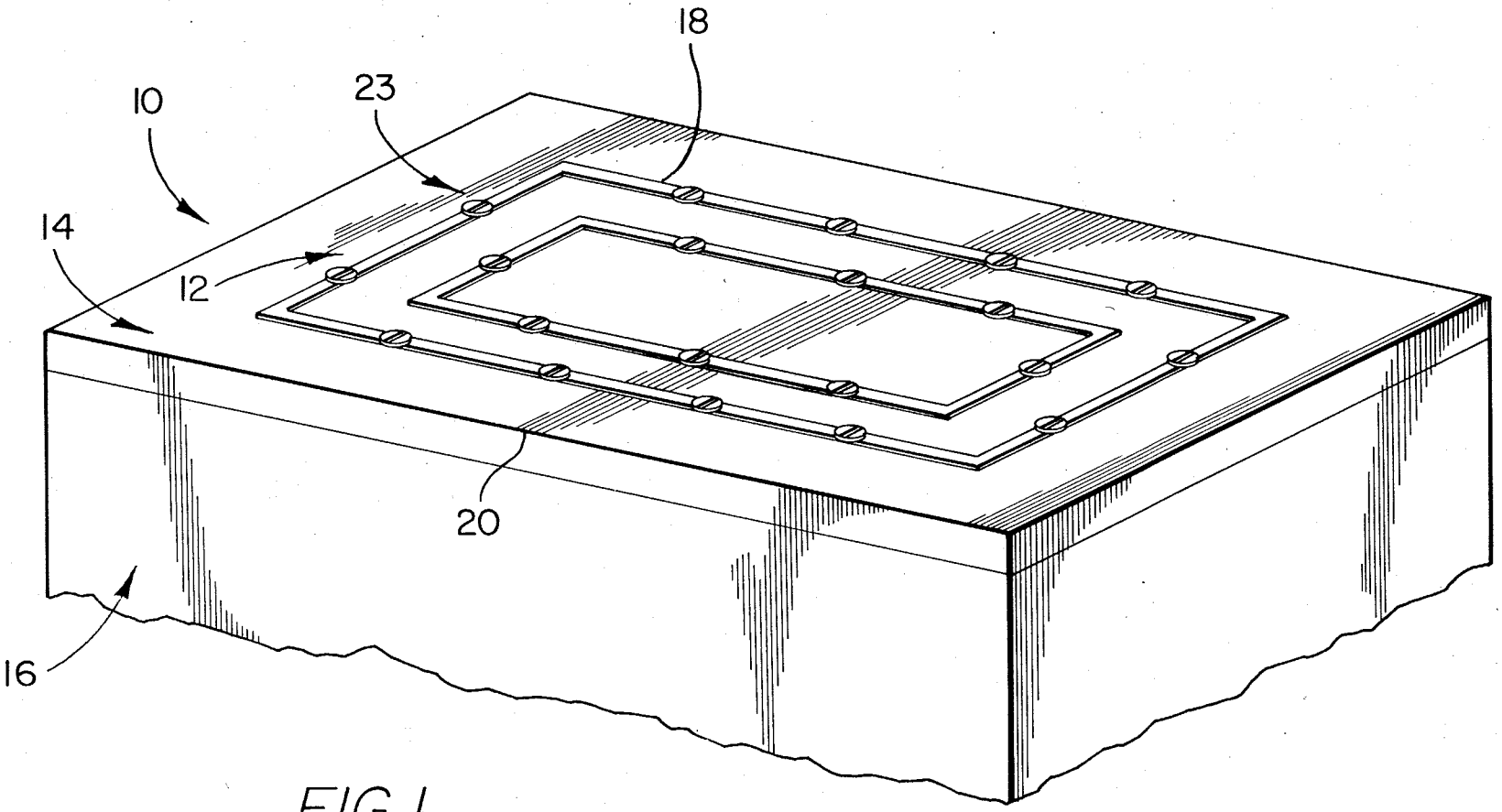
FIG. 1 PRIOR ART
FIG. 1 is an isometric view of a roofing installation utilizing a conventional pattern of battens overlying flexible roof membrane.
Figure 2:
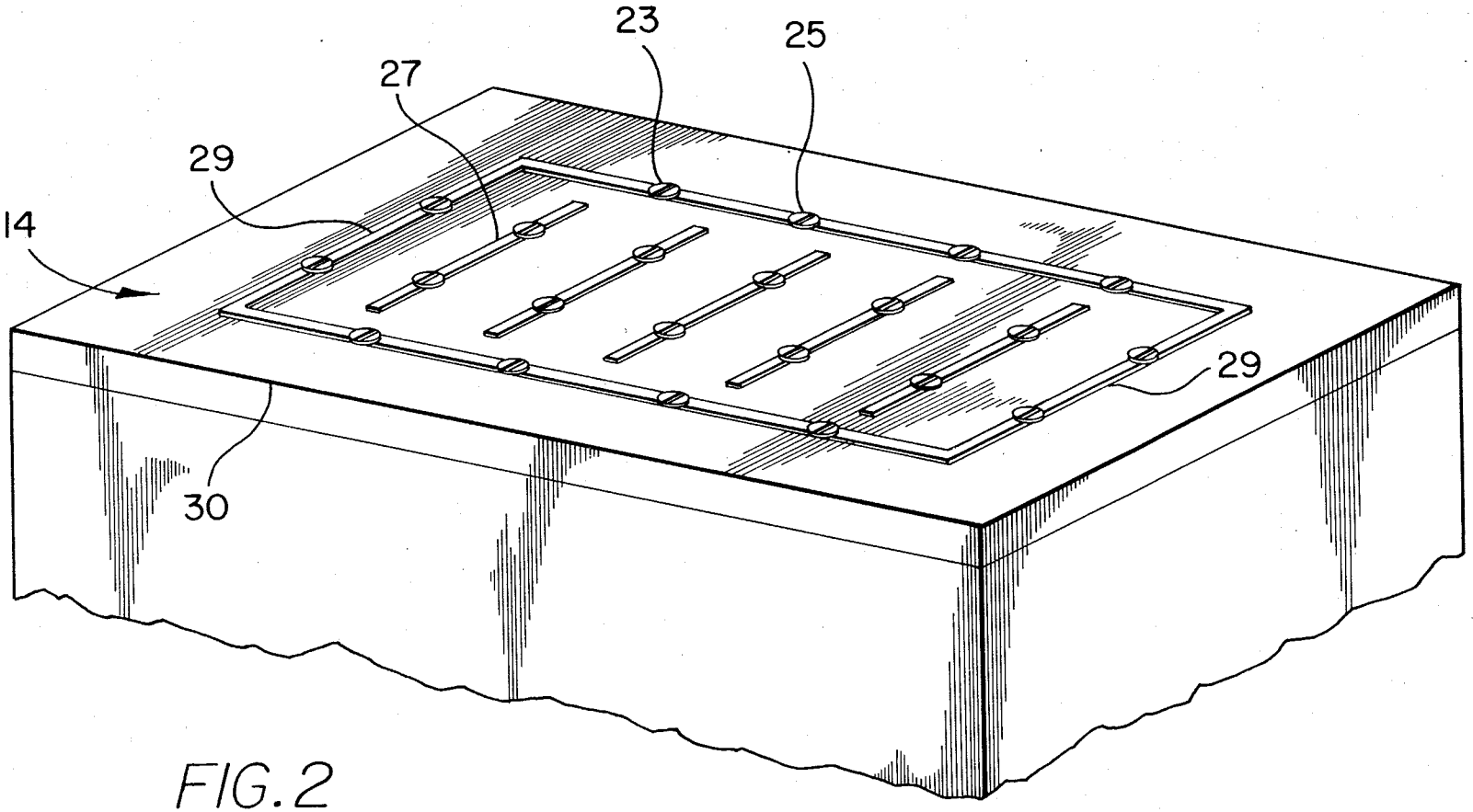
FIG. 2 PRIOR ART
FIG. 2 is an isometric view similar to FIG. 1 and illustrating another conventional pattern of battens.

As illustrated in FIG. 1, there is shown a roofing installation 10 utilizing a conventional method of a parallel arrangement of battens 12 for holding a rubber membrane 14 in place on a roofing structure 16. This conventional arrangement specifically illustrates a series of interconnected runs of battens 18 overlying the membrane 14 with the individual runs in parallel relation to an edge 20 of a building roof. The interconnected runs form closed geometric figures of corresponding shape by of decreasing dimension with a common center. FIG. 2 shows another conventional arrangement wherein interconnected individual runs of battens 25 are respectively installed parallel to the roof edges 30 and an interior set of battens 27 extend in parallel relation to an opposed pair of outer runs of battens 29.

Both of these conventional arrangements shown in FIGS. 1 and 2 allow air to become trapped within the sealed off regions enclosed by the illustrated batten arrangement. Such entrapment of air may result in the membrane sheet 14 ripping or tearing along the portion of the material in contact with the fastener or batten or the fastener or batten becoming dislodged from engagement with support structure.

In FIGS. 1 and 2 there is shown a flexible sheet member 14 suitable for use as a roofing covering. The sheet member may be formed of suitable flexible plastic material Hypalon, Neoprene, and EDPM synthetic rubber. As shown in FIGS. 1 and 2 the battens are secured to the underlying roof substrate by means of a fastener assembly 23 which comprises a relatively long tapered point, a shank portion and an enlarged head portion. Fasteners including nails, screws, toggle bolts, and spreading type wedges and the like may be used dependent upon the roofing substrate construction or configuration.

Figure 3:
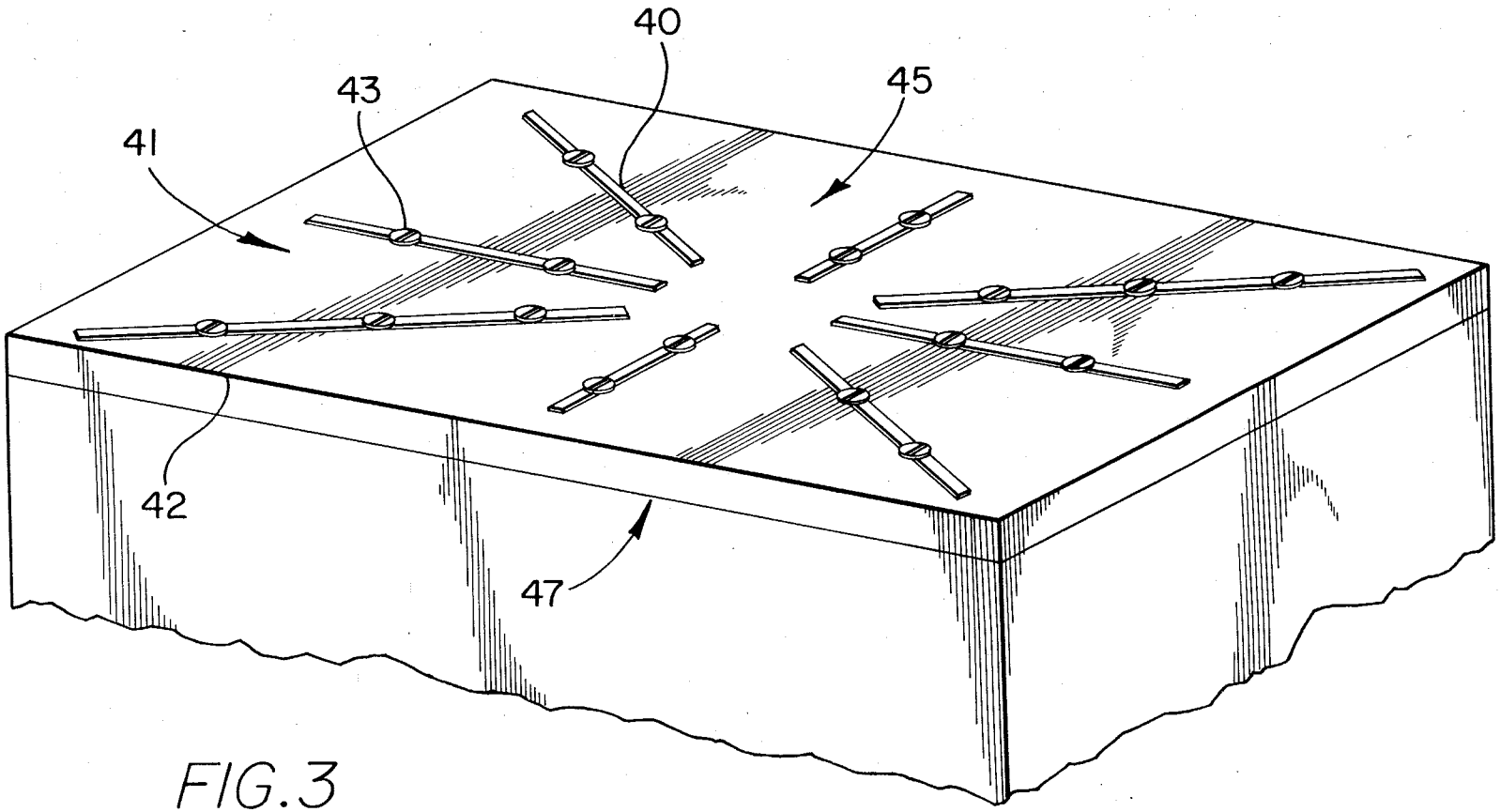
FIG. 3 is an isometric view illustrating a roofing structure incorporating this invention.

The subject invention addresses the problems caused by wind uplift forces which heretofore have been frequently encountered by not effectively solved by known conventional roofing structures. FIG. 3 illustrates a roofing installation installed in accordance with this invention. To overcome the above described problems in a roofing installation, battens 40 are placed in a spoke arrangement wherein multiple battens project outwardly from a central region of the roof toward the roof edges 42 to provide channels or regions formed between adjacent battens 40 which facilitate dispersion of wind uplift forces throughout the roofing surfce area 41. This arrangement precludes any individual areas from being sealed off by the placement of battens, thereby preventing air entrapment within isolated areas of the roofing installation. The battens 40 are secured in place by a series of fastening mechanisms 43 placed along the batten length, the number of fasteners and battens are determined by the roofing configuration.

Battens are made of any suitable material such as sheet metal, wood, aluminum or any similar material. Conventional sealants are placed over fastener mechanisms 43, once installed, to prevent moisture from entering roof substrate.

A preferred installation technique involves positioning the batten 40 as desired on and over the flexible sheet member 45 and then driving the fastener mechanism 43 into an operative position in fixed engagement with the supporting structure 47. To facilitate ready placement and installation, a modified batten may be used which features an adhesive material bonded to the side of the batten which will come into contact with the flexible membrane sheet and is covered with a conventional release material sheet or removable "peel-off" layer of material. The adhesive material may be any suitable pressure sensitive adhesive, butyl gum compound or similar compound. The release or coating material may be any non-adhering material such as wax paper or the like. The use of the adhesive bearing batten will facilitate the placement of battens. By doing so, the membrane installation is more efficient and thereby less labor intensive. Moreover, the wind and water resistance of the roofing installation may be improved by using the modified batten containingthe adhesive material layer to secure flexible membrane sheet to the roofing installation by placing the battens under the membrane sheet.

Thus, where the battens 40 are to overlie the roofing membrane 45, the membrane is first applied to the roof substrate, and the battens are then placed over the applied membrane and secured to the membrane and roof substrate. Where the membrane 45 is to overlie the battens 40, the battens are first secured to the roof substrate and the membrane is then applied over the battens and secured to the roof substrate.

Figure 4:
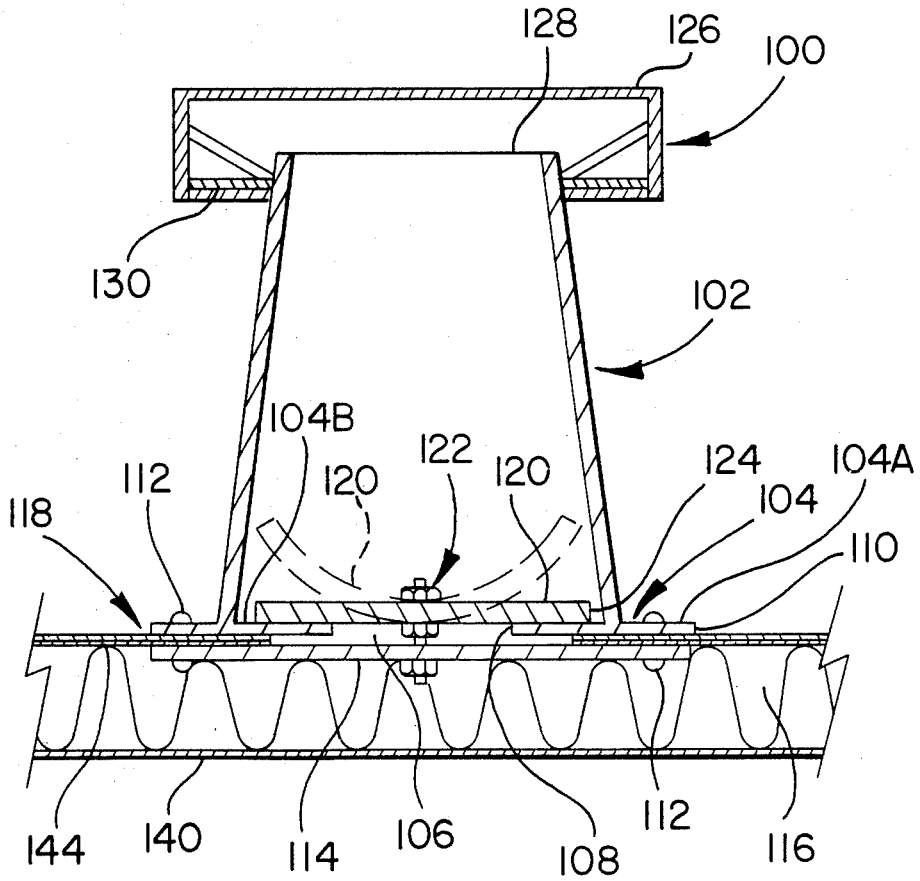
FIG. 4 is a side view, partly in section and partly broken away, showing a pressure equalizer valve used in this invention.

In FIG. 4 a one-way vent 100 with a base 102 having an annular collar 104 is shown extending upwardly from the flexible membrane 118 and communicating with a space 106 between the membrane 118 and the insulating material 116 (fused) with hermetic seal sheet 144. Vent 100 features a one-way diaphram type value having a base 102 shown with a truncated core slope. Base 102 is integrally secured immediate inner and outer edges 108 and 110 of the collar 104. An outer collar rim portion 104A outside the confines of the base 102 is secured such as by rivets 112 or other fasteners to an underlying cross bar 114 extending diametrically across the bottom of base 102 of vent 100. The membrane 118 and hermetic seal sheet 144 are preferably adhesively secured to one another and to the bottom of collar 104 and are shown clamped between collars 104 and cross bar 114. A flexible circular flop valve 120 of any suitable material such as an elastomeric sheet or sheet silicone is fixed at its center to the cross bar 114 by a fastener 122. The outer periphery 124 of the circular flap 120 under normal atmospheric conditions rests on and is supported in a self-sealing manner by an inner collar rim portion 104B within the confines of vent base 102. An upper cover 126 is fixed in overlying relation to an open outlet end 128 of the vent base 102 which preferably is additionally protected against entry of undersirable objects into its open end 128 by suitable screening 130.

Figure 5:
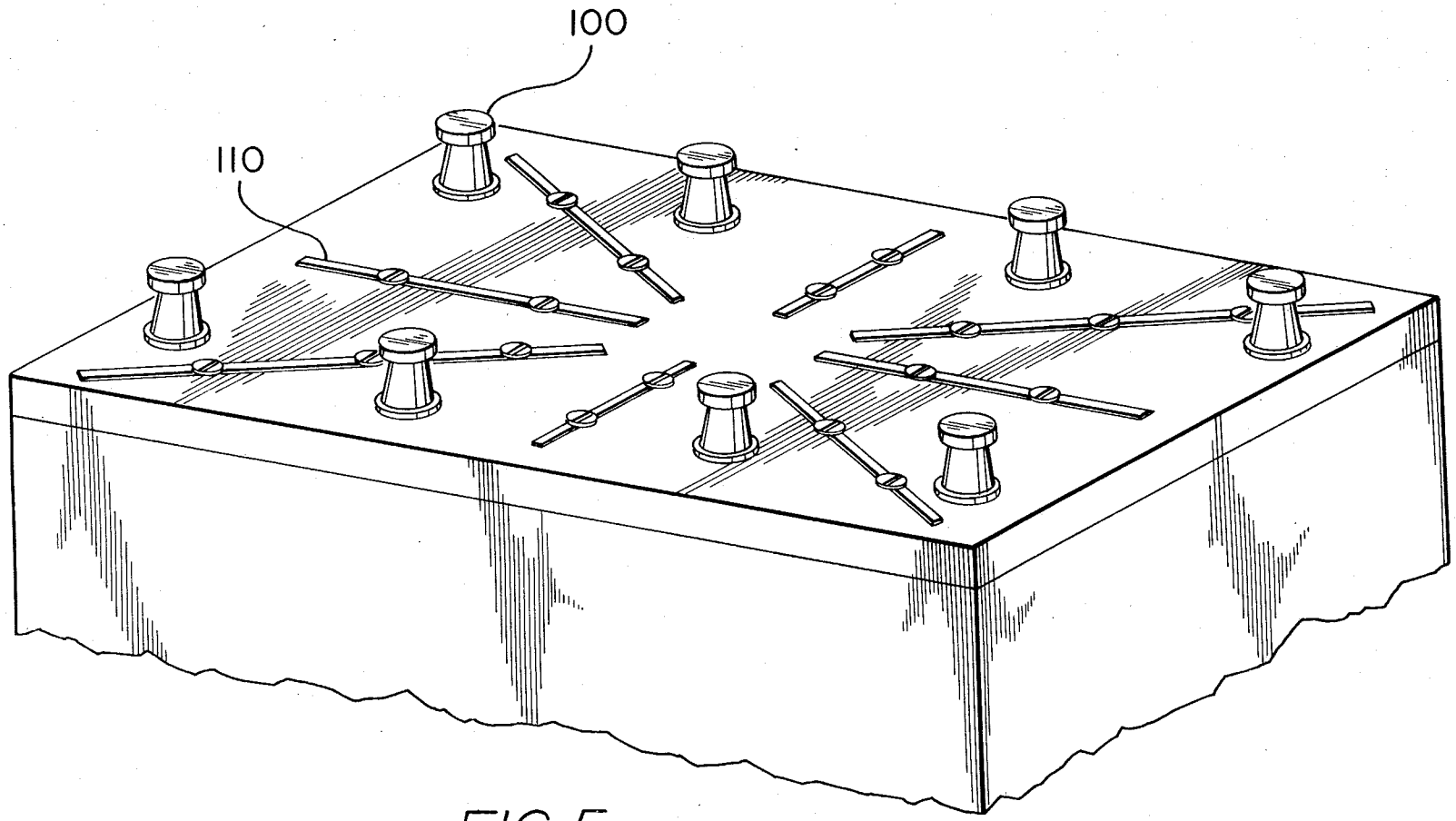
FIG. 5 is an isometric view of a roofing construction utilizing a batten arrangement of this invention in combination with equalizer valves such as the one shown in FIG. 4.

FIG. 5 illustrates a one way vent roof pressure equalizing valve as disclosed in my corresponding U.S. patent application Ser. No. 438,258 entitled "Roofing Structure with Hermetically Sealed Panels". As best seen in FIG. 4, one way vents 100 in the roofing installation between adjacent radially extending battens 101 to allow for optimal dispersion of wind uplift stresses.

Accordingly, vent 100 provides for exhausting air from spaces, such as at 106 in FIG. 4, between the membrane 118 and underlying hermetically sealed insulation 116 upon a differential in air pressure on opposite sides of the membrane 118 effected by the above described wind uplift conditions whereupon the one-way flap valve 120 cups open about its central fastener 122 into a broken line position to permit air exhaust from the interior of hermetically sealed insulating block panels 140.

Figure 6:
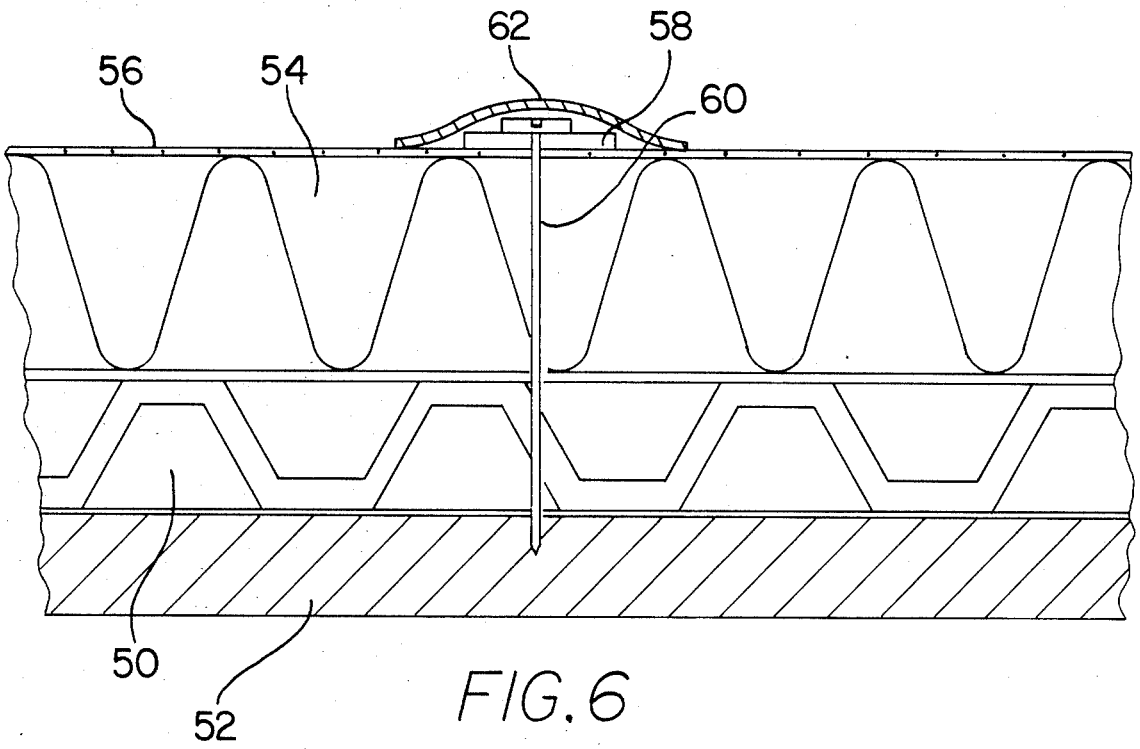
FIG. 6 is a side view, partly in section, illustrating a roofing structure wherein the grommets of the invention are placed underneath the roofing membrane.

FIG. 6 illustrates the installation system provided in accordance with this invention wherein the battens overlie the roof membrane. As shown, a deck 50 is mounted on a supporting structure 52. Where necessary, blocks of insulation 54 are used and are supported on deck 50, with a weatherproof flexible membrane sheet 56 providing an exterior protective insulation cover resistant to ultraviolet or sunlight discoloration, water absorption, freezing and chemicals. A batten 58 is placed over membrane 56 and secured to the underlying substrate by a fastener 60 to hold the membrane 56 in place. If desired, a composition or pathc of reinforcement material 62 may be placed over batten 58 and fastener 60 to provide a water resistant seal. Reinforcement compositions include polyester, nylon, fiberglass or petroleum extract compounds and the like which exhibit water resistance.

Figure 7:
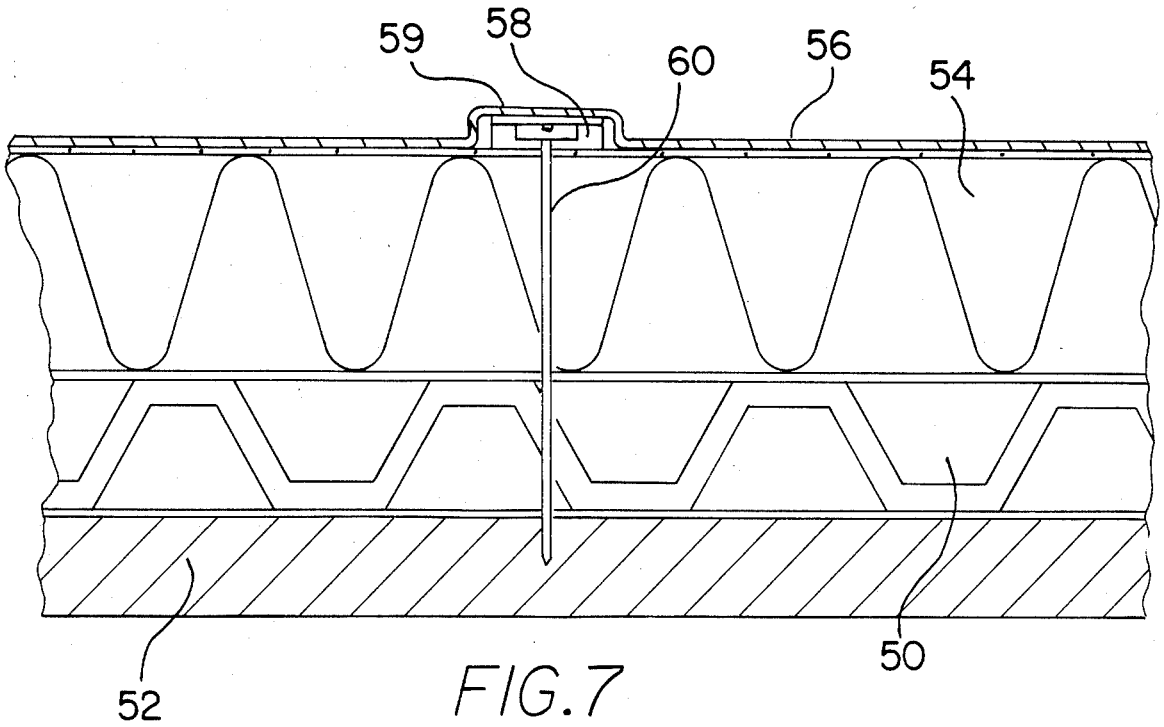
FIG. 7 is a side view, partly in section and partly broken away, of a roofing structure showing an individual batten sandwiched between a flexible membrane sheet and a sealant and being secured to an underlying substrate.

In the embodiment of FIG. 7, wherein the roof membrane overlies the battens, a sheet of flexible material 56 is laminated or adhesively secured to upper surfce of batten 58 via a curable adhesive compound layer 59. Curable adhesives are used to form a high strength bond between batten 58 and membrane 56. A fastener 60 secures batten 58 to hold additional roofing substrates, such as insulation 54 and deck 50, in place.

Figure 8:
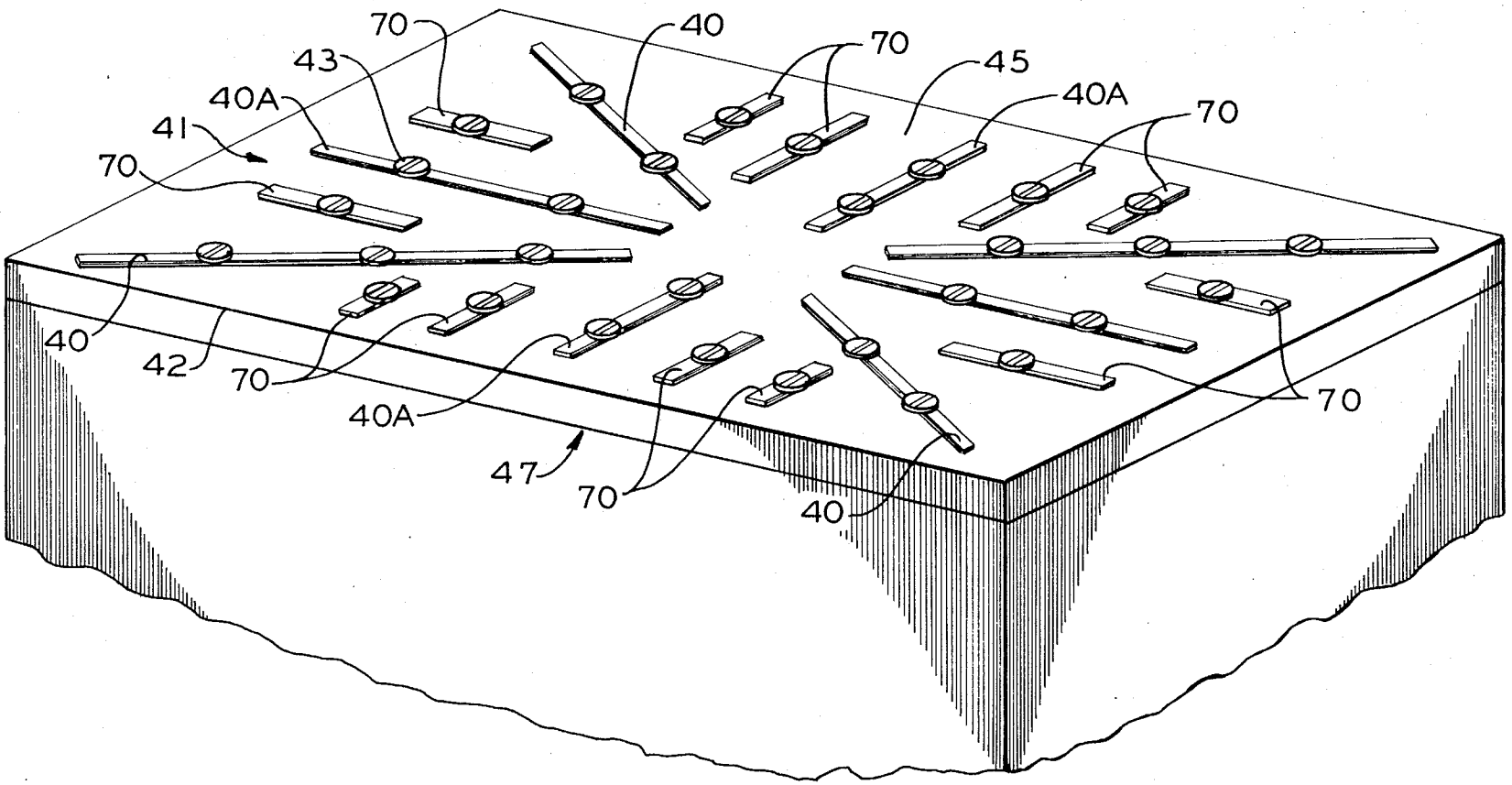
FIG. 8 is an isometric view illustrating another embodiment of the roofing structure incorporating this invention.

In FIG. 8, there is shown the same embodiment as shown in FIG. 3 except that additional battens 70 are shown positioned in a non-radial pattern and perpendicular to the closest portion of roof edge 42. It should be noted that in the radially arranged battens 40, some of these battens **40*a* may also be perpendicular to the closest portion of a roof edge 42. Additional battens 70 are generally positioned between radially arranged battens 40. As with the embodiment of FIG. 3, battens 70 and 40 are positioned so as to provide communication between regions partitioned by adjacent battens and the roof edge to facilitate dispersion of wind uplift forces throughout the roofing installation and to control ballooning of membrane 45. As shown in this FIG. 8, wind uplift forces would have a clear channel of communication from the roof edge 42 toward the central region of the roof and throughout the roofing installation. The battens 70 and 40 may be positioned in underlying or overlying relationship with respect to flexible membrane 45 to secure membrane 45 to the roofing substrate. Installation of the roof shown in FIG. 8 is the same as that for the embodiment of FIG. 3, except for the additional placement and securing of battens 70**.

Figure 9:
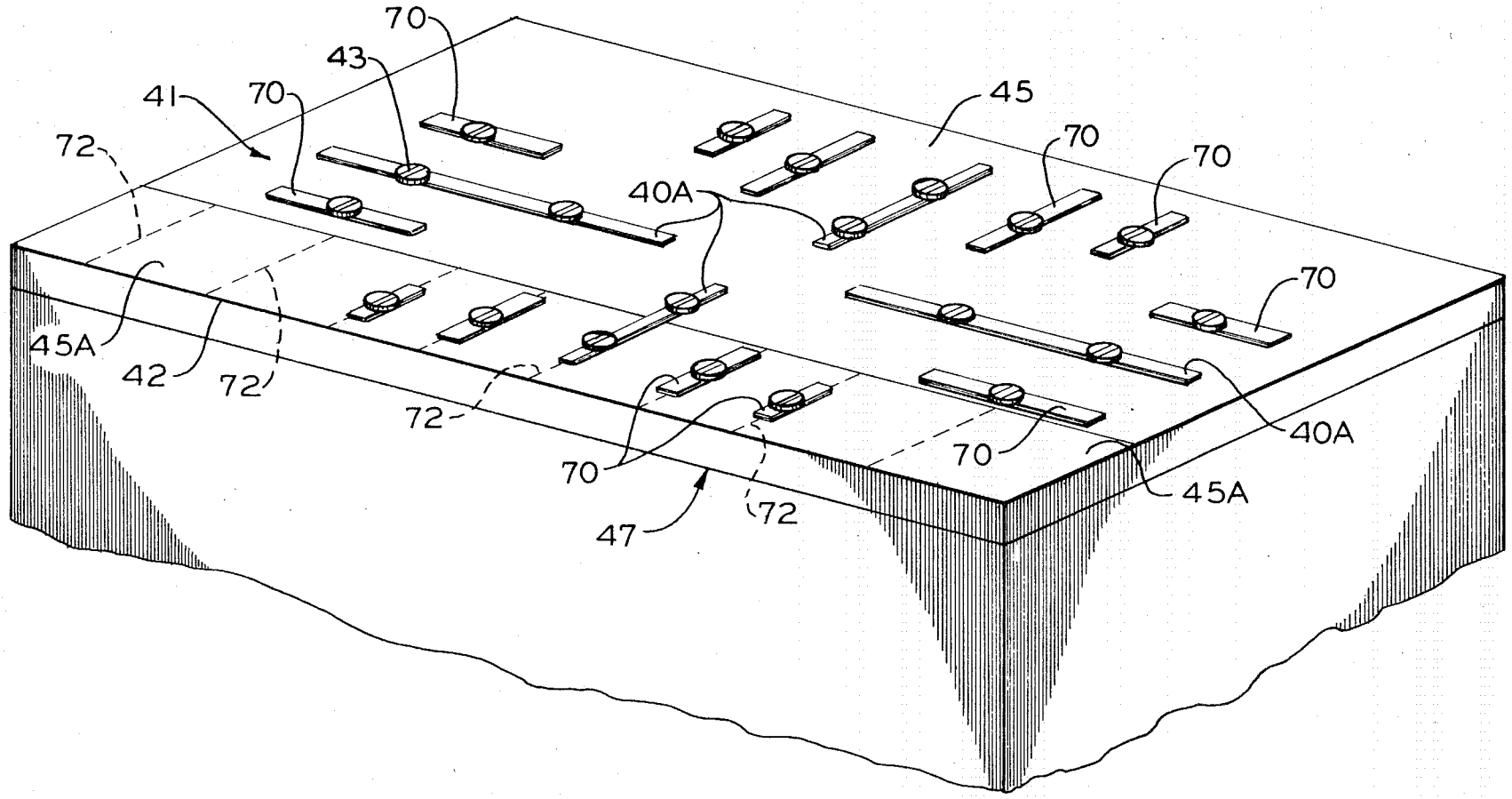
FIG. 9 is an isometric view illustrating yet another embodiment of a roofing structure incorporating this invention.

In FIG. 9 there is shown another aspect and embodiment of the present invention. The same basic roofing installation as that of FIG. 8 is shown except that the radially arranged, non-perpendicular battens have been removed, leaving only the perpendicular, radially arranged battens **40*a* and the additional perpendicular non-radially arranged battens 70. In addition, a single, continuous, manufactured membrane sheet 45*a* is shown making up a portion of flexible membrane 45**.

As is well known to those involved in the roofing art, a flexible roofing membrane, such as that shown as 45, may be comprised of one or more individual, single, continuous sheets such as that shown as 45*a*. These continuous sheets, as they come from the factory, are referred to herein as "manufactured sheets". These manufactured sheets may be up to 50 feet or more in width and up to 300 feet or more in length. These manufactured sheets, especially those with larger dimensions, may be made up of two or more smaller sheets whose size is limited by the width of the calendering rolls on the production machinery. The typical dimensions of calendered sheets is from four (4) to ten (10) feet in width, with varying lengths. These individual calendered sheets are positioned adjacent to one another along their lengths with an overlap of typically four (4) inches. The overlapped areas are secured to form seams and the now larger sheet, whose width is equal to the length of the sheets, is rolled up and vulcanized or further treated to produce a manufactured sheet. The original overlapped and secured areas form seams extending along the width of the manufactured seams and are referred to herein as "manufactured seams". These manufactured sheets, by their extra thickness, provide reinforcing to the membrane. Thus, individual sheets of, for example, 10 by 50 feet, may be joined along manufactured seams to form manufactured sheets of 50 feet in width and any desired length.

Turning back to FIG. 9, manufactured sheet 45*a* is shown containing a plurality of manufactured seams 72 extending perpendicular to the length and across the width of sheet 45*a*. Manufactured sheet 45*a* is laid such that manufactured seams 72 are pendicular to roof edge 42. Battens 70 and 40*a* which overlie sheet 45*a* are shown extended and secured along the manufactured seams in lapping alignment and registry therewith. Battens may be placed over only certain of the manufactured seams and need not align with every manufactured seam. However, where a plurality of battens are in such lapping alignment and registry, the roofing membrane sheet 45*a* is secured to a roof in a manner which improves the resistance of the membrane to wind uplift forces.

The battens 40*a* and 70 should be positioned so as to provide communication between regions partitioned by adjacent battens and the roof edge to faciliate dispersion of wind uplift forces throughout the roofing installation. As with the other embodiments shown herein, the battens 40*a* and 70 may be in underlying or overlying relation to membrane 45 to secure membrane 45 to the roof substrate. Where the flexible membrane is to overlie the battens, measurement of the distance between manufactured seams must be made before the battens are secured to the roof substrate to ensure that the batten spacing corresponds to the manufactured seam spacing. Where the battens are to align with fewer than all of the manufactured seams, the batten spacing should be measured as an integer of two or more times the manufactured seam spacing.

As noted above, flexible membranes 45 may be comprised of one manufactured sheet 45*a* or two or more manufactured sheets joined along seams produced in field installation. Where a plurality of manufactured sheets are employed, they may be positioned in parallel, perpendicular, or any other relationship relative to their lengths.

Radially arranged, non-perpendicular battens may also be employed with the embodiment illustrated in FIG. 9 to secure membrane 45 to the roof substrate and further facilitate dispersion and equalization of wind uplift forces.

As can be seen from the foregoing detailed description, the present invention provides a novel and improved technique for securing flexible roofing membrane sheets to a roofing substrate. By utilizing battens, the membrane is positively secured and the disclosed batten arrangement provides communication between different areas of the roofing installation to permit controlled ballooning without any areas being undesirably isolated or sealed off as taught by the prior art. The technique accordingly allows for dispersion of wind uplift forces by providing intercommunication between all areas of flexible membrane sheeting bordered by the battens. Additionally, the disclosed technique facilitates the installation of roofing membranes in an economical and efficient manner.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A roofing installation comprising a plurality of substrates including a deck, a flexible membrane in overlying relation to the substrates and forming an upper roof surface, and a plurality of battens for securing the membrane to the underlying substrates, the battens being arranged in a radial pattern directed radially outward from a central region of the roofing installation, said pattern allowing for communication between regions of the flexible membrane partitioned by adjacent batten placements and roof edges, thereby providing for controlled ballooning and for dispersion of wind uplift forces throughout the roofing installation.

2. The roofing installation of claim 1 wherein the battens are arranged in a radial pattern directed radially outward from a central region of the roofing installation for dispersion of wind uplift forces througout the roofing installation.

3. The roofing installation of claim 1 wherein each of said battens comprises a strip of material, and wherein fastening means is provided for securing each of the battens to the deck.

4. The roofing installation of claim 1 including a plurality of one-way valves mounted between preselected adjacent battens with each of the valves in communication with an interstice between the flexible membrane and the insulation blocks.

5. The roofing installation of claim 1, wherein each of said battens includes a layer of adhesive bonded to one side of the batten, the adhesive layer having a removable protective coating material thereby facilitating the placement and installation of said battens on the flexible membrane.

6. The roofing installation of claim 5 wherein said flexible membrane is in overlying relation to said plurality of battens containing said adhesive layer, said battens thereby securing said membrane to underlying substrates by contacting said membrane to said adhesive layer.

7. The roofing system of claim 1 wherein said battens are in overlying relation to said flexible membrane.

8. The roofing system of claim 1 wherein at least one of the radially arranged battens is perpendicular to said roof edge.

9. The roofing system of claim 1 including additional battens arranged in a non-radial pattern perpendicular to said roof edge, said non-radial batten pattern allowing for communication between regions of the flexible membrane partitioned by adjacent batten placements and roof edges.

10. The roofing system of claim 9 wherein said flexible membrane comprises at least one continuous sheet having manufactured seams perpendicular to the length of said sheet and to at least a portion of said roof edge, and wherein said perpendicularly arranged battens extend along at least certain of said manufactured seams.

11. The roofing system of claim 10 wherein said battens are in overlying relation to said flexible membrane manufactured seams.

12. The roofing system of claim 10 wherein said battens are in underlying relation to said flexible membrane manufactured seams.

13. A method of installing a roof over a roof substrate having an edge comprising the steps of:

(a) providing a flexible membrane;

(b) applying said flexible membrane over said roof substrate;

(c) placing a plurality of battens over said roof substrate in a radial pattern directed outwardly from a central region of said roof substrate;

(d) securing said placed battens to said roof substrate; and (e) securing said placed battens to said flexible membrane, thereby permitting communication between regions of the flexible membrane partitioned by the placed and secured battens and said roof edge, and providing for controlled ballooning and for dispersion of wind uplift forces in the roof.

14. The method of claim 13 wherein step (c) includes placing at least one of said battens perpendicular to said roof edge.

15. The method of claim 13 additionally including, a step (c'), prior to steps (d) and (e), of placing additional battens over said roof substrate in a non-radial pattern perpendicular to at least a portion of said roof edge.

16. The method of claim 15 wherein step (a) includes providing a flexible membrane comprising at least one continuous manufactured sheet having spaced manufactured seams perpendicular to the length of said sheet; wherein step (b) includes applying said flexible membrane such that said manufactured seams are perpendicular to at least a portion of said roof edge; wherein step (c') includes spacing said perpendicular battens a distance equal to an integer multiple of the spacing of said flexible membrane manufacture seams; and additionally, including a step (c'), prior to steps (d) and (e), of aligning said flexible membrane manufactured seams and said perpendicular battens in lapping relationship.

17. The method of claim 13 wherein step (c) follows step (b) and includes placing said battens in overlying relation to said applied flexible membrane.

18. The method of claim 13 wherein step (b) follows steps (c) and (d) and includes applying said flexible membrane in overlying relation to said placed and secured battens.

19. The method of claim 18 wherein said step (e) securing is by an adhesive.

20. A roofing installation comprising a plurality of substrates including a deck; a flexible membrane in overlying relation to the substrates and forming an upper roof surface, said flexible membrane comprising at least one continuous manufactured sheet having manufactured seams perpendicular to the length of said sheet and to at least a portion of the roof edge; and a plurality of battens for securing the membrane to the underlying substrates, the battens being arranged perpendicular to said portion of said roof edge and extending along at least certain of said manufactured seams, said battens permitting communication between regions partitioned by adjacent batten placements and said portion of said roof edge thereby providing for controlled ballooning and for dispersion of wind uplift forces in the roofing installation.

21. The roofing membrane of claim 20 wherein said battens are in overlying relation to said flexible membrane manufactured seams.

22. The roofing installation of claim 20 wherein said battens are in underlying relation to said flexible membrane manufactured seams.

23. A method of installing a roof over a roof substrate having an edge comprising the steps of:

(a) providing a flexible membrane comprising at least one continuous manufactured sheet having spaced manufactured seams perpendicular to the length of said sheet;

(b) applying said flexible membrane over said roof substrate such that said manufactured seams are perpendicular to at least a portion of said edge;

(c) placing a plurality of battens over said roof substrate perpendicular to a portion of said edge and spaced apart a distance equal to an integer multiple of the spacing of said flexible membrane manufactured seams;

(d) aligning said flexible membrane manufactured seams and said battens in lapping relationship;

(e) securing said placed battens to said roof substrate; and (f) securing said placed battens to said flexible membrane, thereby permitting communication between regions of the flexible membrane partitioned by the placed and secured battens and said portion of said roof edge and providing for controlled ballooning and for dispersion of wind uplift forces in the roof.

24. The method of claim 23 wherein step (c) follows step (b) and includes placing said battens in overlying relation to said applied flexible membrane.

25. The method of claim 23 wherein step (b) follows steps (c) and (e) and includes applying said flexible membrane in overlying relation to said placed and secured battens.

* * * * *

UNITED STATES PATENT AND TRADEMARK OFFICE

CERTIFICATE OF CORRECTION

PATENT NO. : 4,736,562

DATED : April 12, 1988

INVENTOR(S) : Thomas L. Kelly

It is certified that error appears in the above-identified patent and that said Letters Patent is hereby corrected as shown below:

Column 4, line 9, wherein the word "uplife" should be --uplift--.

Column 4, line 23, wherein the word "by of" should be --but of--.

Column 4, line 61, wherein the word "surfce" should be --surface--.

Column 5, line 25, wherein the word "containingthe" should be --containing the--.

Column 6, line 23, wherein the word "pathc" should be --patch--.

Column 6, line 31, wherein the word "surfce" should be --surface--.

Signed and Sealed this

Eighteenth Day of October, 1988

*Attest:*

*Attesting Officer*

DONALD J. QUIGG

*Commissioner of Patents and Trademarks*